US005094642A

United States Patent [19]

Reichelt et al.

[11] Patent Number: 5,094,642

[45] Date of Patent: Mar. 10, 1992

[54] METHOD OF MANUFACTURING A CONTROL SUBASSEMBLY FOR FLAT DISPLAY DEVICES

[75] Inventors: Michael Reichelt, Esslingen; Kurt-Manfred Tischer, Wendlingen, both of Fed. Rep. of Germany

[73] Assignee: Nokia Unterhaltungselektronik, Fed. Rep. of Germany

[21] Appl. No.: 635,140

[22] PCT Filed: Jun. 27, 1989

[86] PCT No.: PCT/EP89/00722

§ 371 Date: Dec. 28, 1990

§ 102(e) Date: Dec. 28, 1990

[87] PCT Pub. No.: WO90/00306

PCT Pub. Date: Jan. 11, 1990

[30] Foreign Application Priority Data

Jun. 28, 1988 [DE] Fed. Rep. of Germany ..... 3821748

[51] Int. Cl.[5] ..... H01J 9/18

[52] U.S. Cl. ..... 445/33; 445/24

[58] Field of Search ..... 445/33, 24, 25, 35

[56] References Cited

U.S. PATENT DOCUMENTS

| | | | |
|---|---|---|---|
| 4,521,251 | 4/1985 | Otake et al. | 106/183 |
| 4,651,049 | 3/1987 | Saeki et al. . | |
| 5,011,391 | 4/1991 | Kawasaki et al. | 445/24 |

FOREIGN PATENT DOCUMENTS

| | | | |
|---|---|---|---|
| 50294 | 4/1982 | European Pat. Off. . | |
| 1927019 | 12/1970 | Fed. Rep. of Germany . | |
| 126934 | 10/1980 | Japan | 445/24 |
| 174821 | 10/1982 | Japan . | |
| 211736 | 10/1985 | Japan . | |
| 98535 | 5/1987 | Japan | 445/24 |

*Primary Examiner*—Kenneth J. Ramsey
*Attorney, Agent, or Firm*—Peter C. Van Der Sluys

[57] ABSTRACT

For a flat display device, a control subassembly is needed which consists of two control plates (1;7) each formed by a layer of parallel conductors (2;8) which are isolated from each other. During the manufacture of the control subassembly, the first control plate is provided with a glass frit in the form of continuous strips (10) perpendicular to the conductors. The glass frit is set, and the application of the strips is repeated. The second control plate is then put on the first control plate in such a way that their conductors are mutually perpendicular. After that, the glass frit is crystallized.

5 Claims, 3 Drawing Sheets

METHOD OF MANUFACTURING A CONTROL SUBASSEMBLY FOR FLAT DISPLAY DEVICES

The present invention relates to a method of manufacturing a control subassembly for a flat display device, said control subassembly consisting of a first control plate and a second control plate, as set forth in the preamble of claim 1.

Such a method is disclosed in European Patent 0,050,294. In that method, a first glass frit is applied to a first control plate and then heated until it crystallizes. Next, a second glass frit is applied to the crystallized glass frit, and the second control plate is placed on it. Further heating causes the second glass frit to crystallize, whereby the two control plates are bonded together in a predetermined spaced relationship from each other. This method requires two different glass frits with different crystallization points. Another disadvantage is that two heating processes to about 450° C. and 350° C., respectively, are necessary.

It is the object of the present invention to provide a simple method for manufacturing control subassemblies of the kind as mentioned.

The method according to the present invention for manufacturing a control subassembly comprising a first control plate and a second control plate, whereby these control plates each comprise a layer of parallel conductors isolated from one another, comprises the following procedure of steps:

- forming control plates with holding members interconnecting all conductors,
- applying several superposed layers of glass-frit to the first control plate in continuous stripes perpendicular to its conductors, whereby a heating step follows to each applying step, said heating being sufficient only for solidification, but not for crystallization of the glass-frit,
- laying the second control plate on the glass-frit,
- aligning the control plates so that the conductors are mutually perpendicular,
- heating the glass-frit until crystallization, and
- removing the holding elements,
- whereby a glass-frit is used consisting of a frit powder, a binder of methylmethacrlate, and a solvent of Buthyldiglykol-acetate and Cyclohexanon.

This method differs from that one according to EP-A-0 050 294 in three viewpoints, i.e.:

- glass frit is not provided in short stripes on respective single conductors, but each glass-frit stripe is continuously supplied rectangularly over all conductors and the spaces therebetween, which method simplifies very much the application of the glass-frit stripes;
- heating is not made till the crystallization temperature after each application of a layer of glass-frit stripes, but only till solidification of the glass-frit. Heating until crystallization is only provided after arranging the second control plate and aligning the control plates against each other. This procedure has a shortened sequence of the method steps as a consequence, with application of reduced energy; and
- a special frit is used, being especially suited for implementing the above-mentioned two procedural steps.

In a preferred embodiment, the holding members are provided with lign-shaped portions of reduced cross-sectional area in connection to the conductors. Due to these holding members, handling of the control plate before assembling to the control subassembly is easy. After assembling these holding members may be easily removed by bending over.

In the following, the application is explained by embodiments illustrated by drawings, in which.

The control subassembly fabricated by the novel method, after being united with a perforated extract anode, can be used as a control system in the flat evacuated display device disclosed in the not prepublished EP-A-0311938. This display device has a phosphor-dot glass faceplate and a back metal envelope. In the latter, an area cathode consisting of a periodic array of filaments is disposed in front of a segmented counterelectrode, and the control system, consisting of the perforated extract anode, which is attached to a frame, and the control subassembly bonded thereto, is disposed in front of the area cathode.

Figure 1:
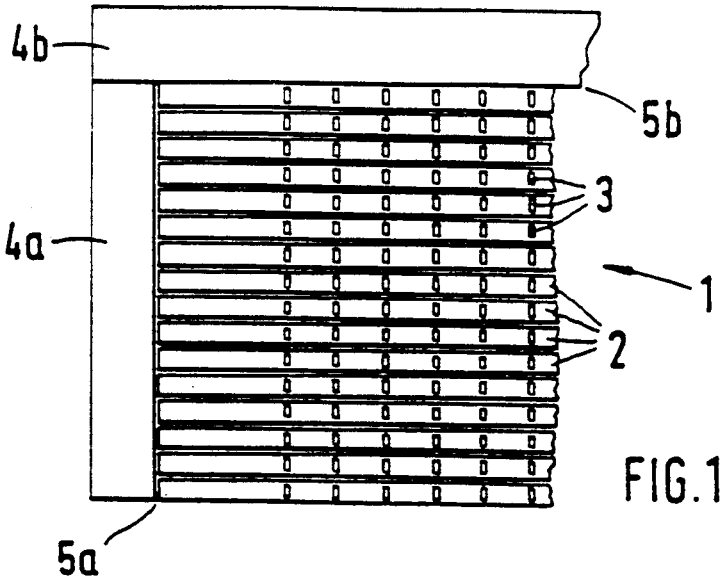
FIG. 1 is a top view of a part of the first control plate with holding edges prior to the application of the glass frit.

The first control plate 1, shown in FIG. 1 in a top view, consists of a plurality of coplanar, parallel conductors 2 which are isolated from each other. The conductors 2 are provided with a regular pattern of holes 3. To be able to handle this unstable structure during the manufacture of the control subassembly, the control plate is surrounded by holding edges 4*a* and 4*b*. All ends of the conductors 2 are connected with the holding edges 4*a* by a line-shaped portion of reduced cross-sectional area 5*a*, and the two outer conductors are connected with the holding edges 4*b* by a line-shaped portion of reduced cross sectional area 5*b*.

Figure 2:
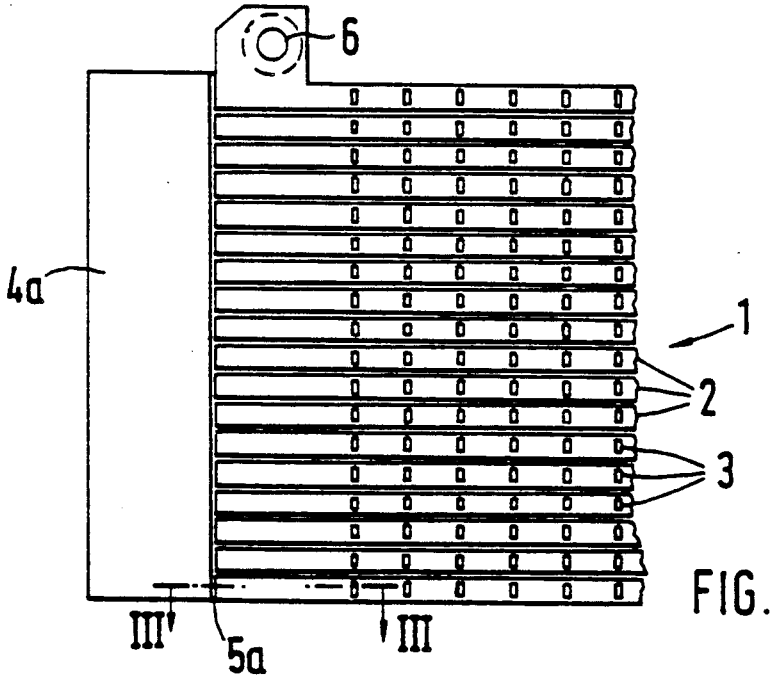
FIG. 2 is a top view of the first control plate with a simplified holding edge prior to the application of the glass frit.

FIG. 2 shows the control plate 1 with simplified holding edges. In this embodiment, only the ends of the conductors 2 are linked via the portion of reduced cross-sectional area 5*a* with the holding edges 4*a*. The outer conductors have alignment marks 6 near their ends.

Figure 3:
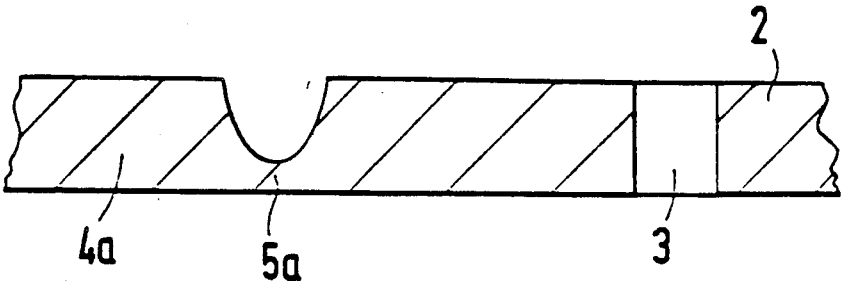
FIG. 3 is a section taken along line III—III of FIG. 2.

FIG. 3 shows a section taken along line III—III of FIG. 2. The portion of reduced cross-sectional area 5*a* is formed by an etching process, for example, which may take place simultaneously with the etching of the control plate to obtain the conductors 2 and the holes 3. The thickness of the portion of reduced cross-sectional area is about one fourth the thickness of the control plate.

Figure 4:
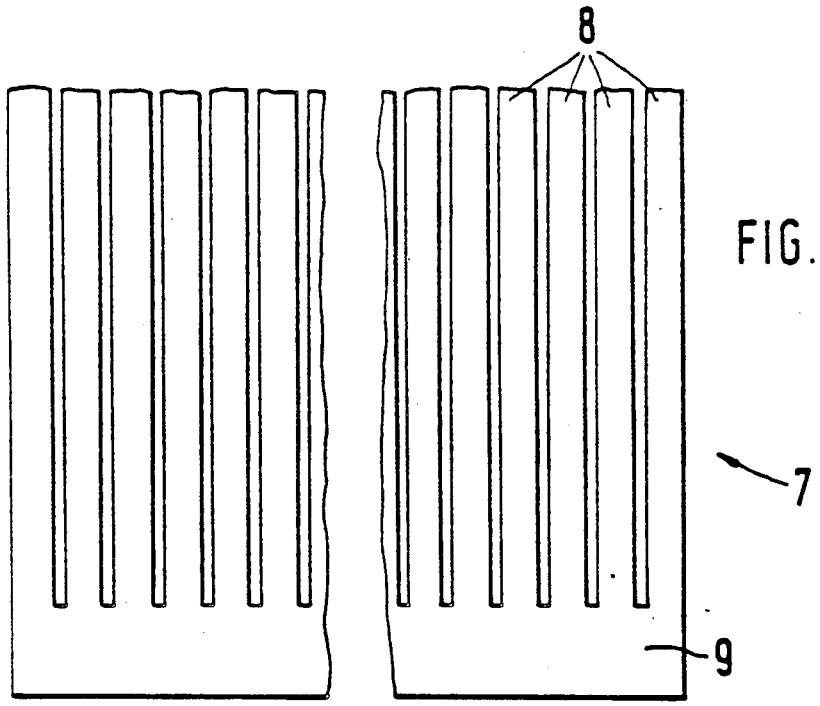
FIG. 4 is a top view of a part of the second control plate.

FIG. 4 shows the second control plate 7, which consists of a plurality of coplanar, parallel conductors 8 that are isolated from each other. To be able to handle this unstable structure during the manufacture of the control subassembly, the ends of the conductors 8 are linked by holding edges 9.

Figure 5:
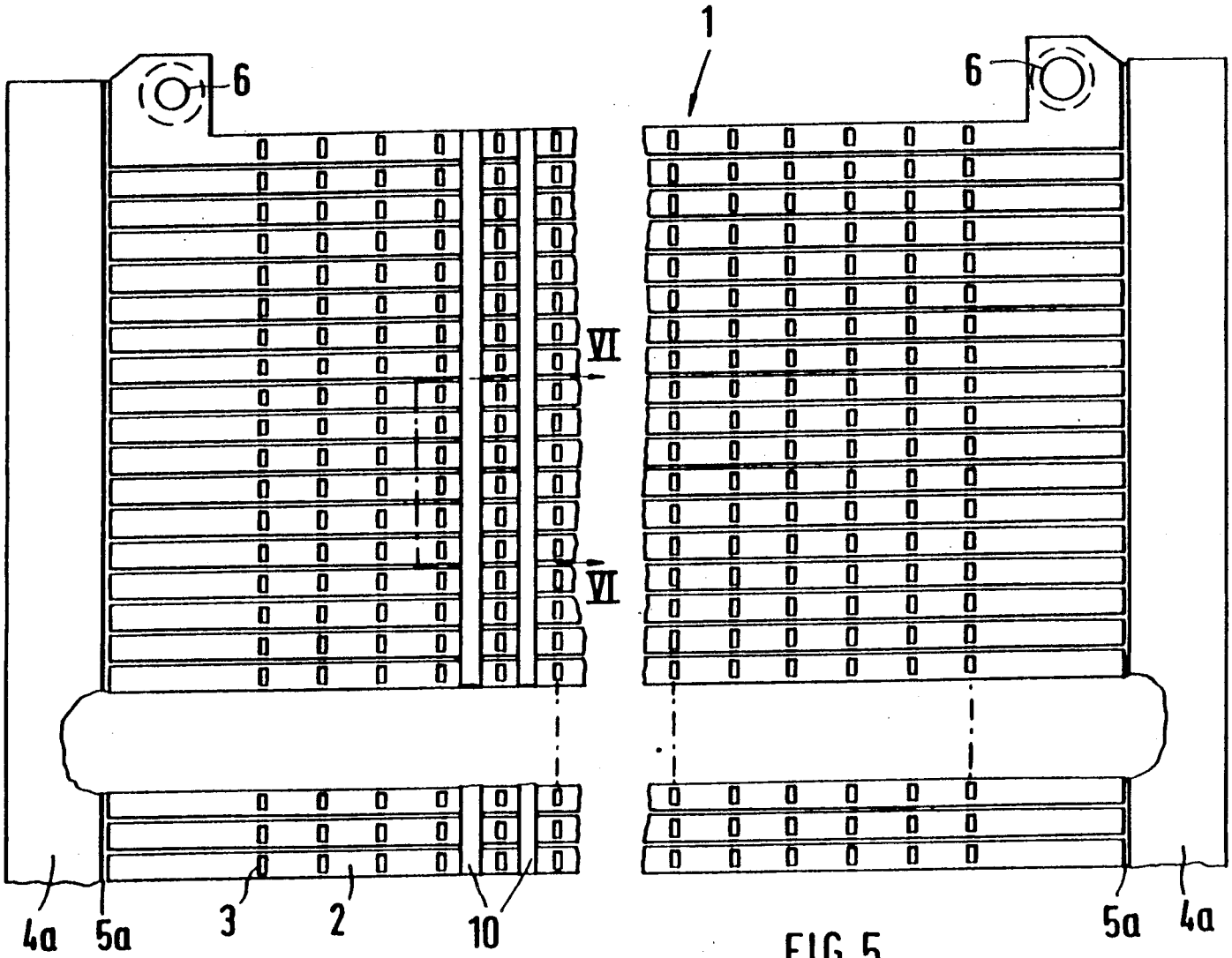
FIG. 5 is a top view of the first control plate of FIG. 2 after application of the glass frit.

The first control plate 1 is provided with a glass frit using silk-screening techniques. FIG. 5 shows part of the first control plate of FIG. 2 after this process. The glass frit is applied in the form of strips 10 which are perpendicular to the conductors 2 and cover the conductors and the spaces between the conductors. Each of the strips 10 lies between two rows of holes, and it is important that the holes remain uncovered. For the sake of clarity, only two strips 10 are shown. In a practical embodiment, strips of glass frit are present beside all rows of holes.

The glass frit consists, for example, of the type G 017-918/K4 of Schott, Landshut, a binder of methyl methacrylate, available under the name "Elvacite Type 2041" from DU PONT DEMOURS, Düsseldorf, and a solvent consisting of buthyl diglycol acetate and cyclohexanone. 200 g of frit powder are mixed with 30 g of binder and solvent in the usual manner to obtain the glass frit. The 30 g of binder and solvent contain Elvacite, buthyl diglycol acetate, and cyclohexanone in a weight ratio of 0.2:1:1.

This glass frit is set by the action of heat, e.g., by hot air or preferably by irradiation with infrared light for 1 to 5 minutes. In this manner, the first control plate is stabilized and the risk of crosses between the conductors during displacement of the control plate is avoided. In addition, further glass frit can be deposited on the strips 10 applied first. For the irradiation with infrared light, the first control plate need not be removed from the silk-screening apparatus, so that further glass frit can be applied immediately thereafter without realignment. This process is repeated until the desired thickness of the glass frit is achieved. Compared with the width of the strips, very great strip thicknesses can be achieved, which may measure several 100 micrometers.

Figure 6:
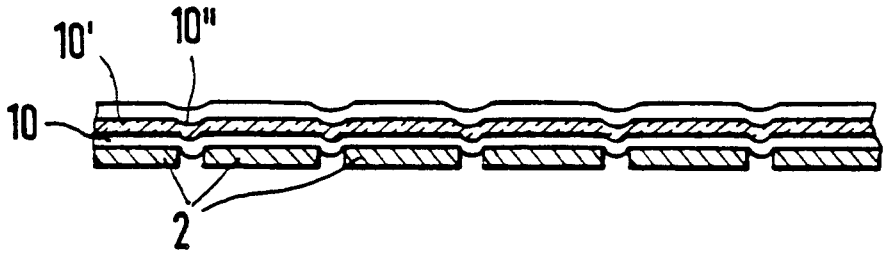
FIG. 6 is a section taken along line VI—VI of FIG. 5.

In FIG. 6, the first control plate 1, provided with glass frit, is shown in a section taken along line VI—VI of FIG. 5. In this example, three superposed strips of glass frit are present on the conductors 1 of the control plate. These strips were applied one after the other and are denoted by 10, 10', and 10''.

On the first control plate 1, provided with the glass frit, the second control plate 7 is laid, which is shown in FIG. 4. The two control plates 1 and 7 are so aligned relative to each other that the conductors 2 and 8 are mutually perpendicular and the holes 3 are centrically below the slots between the conductors 8. Then, heat is applied to crystallize the glass frit. The two control plates are thus joined together in a spaced relationship from each other, the distance between them being determined by the thickness of the strips 10. The temperatures and duration of this fritting process are given in the data sheet of the manufacturer of the frit powder.

Figure 7:
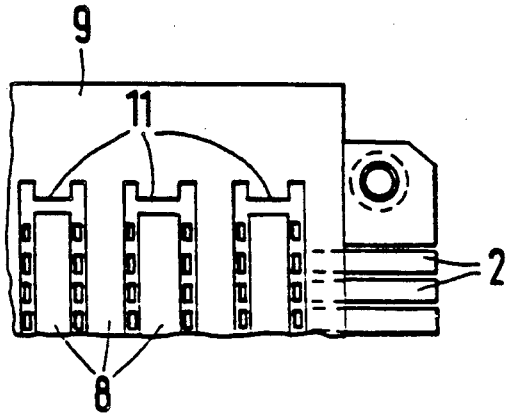
FIG. 7 is a top view of a part of the finished control subassembly.

Next, the holding edges 4*a* are removed from the first control plate 1 by being bent over. In the second control plate 7, isolation grooves 11 are formed in the holding edges 9, e.g., by stamping, such that conductors lying side by side are electrically isolated from each other. The advantage of the stamping of the isolation grooves lies in the fact that no stress is produced in the conductors. Through the positions of the isolation grooves, an interdigital structure of the conductors 8 is obtained, with the holding edges now serving as electric connecting lines. A top view of the control subassembly formed from the two control plates is shown in FIG. 7. This control subassembly is stable and can now be frit-bonded to a perforated extract anode to form the control system needed in the flat display device.

We claim:

1. Method of manufacturing a control subassembly for a flat display device, said control subassembly consisting of a first control plate and a second control plate each formed by a layer of parallel conductors isolated from one another, comprising the following steps:

forming control plates with holding members interconnecting all conductors;

applying several superposed layers of glass frit to the first control plate, whereby a heating step follows to each applying step;

laying the second control plate on the glass frit;

aligning the control plates so that the conductors are mutually perpendicular; and removing the holding elements, characterized in that the glass frit, consisting of a frit powder, a binder of methyl methacrylate, and a solvent of buthyl diglycol acetate and cyclohexanone, is applied to the first control plate as continuous strips perpendicular to the conductors, that after each application, the glass frit is set by heat, and that, after adjustment of the control plates against each other, the subassembly is heated until the glass frit crystallizes.

2. A method as claimed in claim 1, characterized in that the heat is in the form of infrared radiation.

3. A method as claimed in claim 1, characterized in that the holding members of at least the first control plate are constituted by holding edges which surround the control plate and between which and the conductors there is a line-shaped portion of reduced cross-sectional area, and which are removed by being bent over.

4. A method as claimed in claim 3, characterized in that the holding edges are present only at the sides perpendicular to the conductors.

5. A method as claimed in claim 1, characterized in that the holding members of at least the second control plate are constituted by holding edges at the sides perpendicular to the conductors, and are removed by cutting.

* * * * *